US009087512B2

(12) United States Patent
Chen et al.

(10) Patent No.: US 9,087,512 B2
(45) Date of Patent: Jul. 21, 2015

(54) SPEECH SYNTHESIS METHOD AND APPARATUS FOR ELECTRONIC SYSTEM

(71) Applicants: Yu-Chieh Chen, Taipei (TW); Chih-Kai Yu, Taipei (TW); Sung-Shen Wu, Taipei (TW); Tai-Ming Parng, Taipei (TW)

(72) Inventors: Yu-Chieh Chen, Taipei (TW); Chih-Kai Yu, Taipei (TW); Sung-Shen Wu, Taipei (TW); Tai-Ming Parng, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 289 days.

(21) Appl. No.: 13/737,955

(22) Filed: Jan. 10, 2013

(65) Prior Publication Data

US 2013/0191130 A1 Jul. 25, 2013

Related U.S. Application Data

(60) Provisional application No. 61/588,674, filed on Jan. 20, 2012.

(51) Int. Cl.
*G10L 13/08* (2013.01)
*G10L 13/02* (2013.01)

(52) U.S. Cl.
CPC ..... *G10L 13/08* (2013.01); *G10L 13/02* (2013.01)

(58) Field of Classification Search
CPC ..... G10L 13/08
USPC ..... 704/260
See application file for complete search history.

(56) References Cited

U.S. PATENT DOCUMENTS

| | | | | |
|---|---|---|---|---|
| 6,446,040 | B1 * | 9/2002 | Socher et al. | 704/260 |
| 8,219,398 | B2 * | 7/2012 | Marple et al. | 704/260 |
| 8,898,568 | B2 * | 11/2014 | Bull et al. | 715/727 |
| 2004/0111271 | A1 | 6/2004 | Tischer | |
| 2010/0161327 | A1 | 6/2010 | Chandra et al. | |

* cited by examiner

*Primary Examiner* — Susan McFadden
(74) *Attorney, Agent, or Firm* — Jianq Chyun IP Office

(57) ABSTRACT

A speech synthesis method for an electronic system and a speech synthesis apparatus are provided. In the speech synthesis method, a speech signal file including text content is received. The speech signal file is analyzed to obtain prosodic information of the speech signal file. The text content and the corresponding prosodic information are automatically tagged to obtain a text tag file. A speech synthesis file is obtained by synthesizing a human voice profile and the text tag file.

10 Claims, 3 Drawing Sheets

SPEECH SYNTHESIS METHOD AND APPARATUS FOR ELECTRONIC SYSTEM

CROSS-REFERENCE TO RELATED APPLICATION

This application claims the priority benefit of U.S. provisional application Ser. No. 61/588,674, filed on Jan. 20, 2012. The entirety of the above-mentioned patent application is hereby incorporated by reference herein and made a part of this specification.

BACKGROUND OF THE INVENTION

1. Field of the Invention

The disclosure relates to a speech synthesis mechanism. More particularly, the disclosure relates to a prosody-based speech synthesis method and a prosody-based speech synthesis apparatus.

2. Description of Related Art

As the development of science and technology improved, communication requirements between humans and computers are not never like before that instructions are inputted only by typing and responses are received only in a text form on computers. Therefore, the development of a user-friendly voice communication mechanism between humans and computers has become a very important issue. For a computer, in order to converse human voice into an audio voice, technologies of voice recognition and speech synthesis are required. For instance, a text-to-speech (TTS) technology could be applied to convert a text input into a voice output.

Therefore, the synthesis of prosody speech has become an indispensable technology for most of the prevailing TTS technologies involving prosody speech. For instance, an interactive robot designed for children may need to tell a story which is full of human-like rhythm and emotional prosody. Different contents in a text could be combined with proper prosodic information such that the synthesized speech may become lively and vivid. The prosodic information is manually set in most cases; however, in order to accomplish a satisfactory performance, settings and adjustments of the prosodic information may require significant amount of time based on trial and error.

SUMMARY OF THE INVENTION

The disclosure provides a speech synthesis method for an electronic system and a speech synthesis apparatus; thereby, prosodic information is automatically obtained, such that the synthesized speech would be more similar to human voice.

In an embodiment of the disclosure, a speech synthesis method for an electronic system is provided. The speech synthesis method includes performing a text tagging process and a prosody mimicking process. The text tagging process includes: receiving a speech signal file, wherein the speech signal file includes text content and prosodic information; analyzing the speech signal file to obtain the prosodic information and the text content of the speech signal file, respectively; automatically tagging the text content and the corresponding prosodic information to obtain a text tag file. The prosody mimicking process includes: synthesizing a human voice profile and the text tag file to obtain a speech synthesis file. Here, the human voice profile includes a plurality of human voice models corresponding to the text content.

In an embodiment of the disclosure, a speech synthesis apparatus that includes a text tagging apparatus and a prosody mimicking apparatus is provided. The text tagging apparatus receives a speech signal file and includes a text recognizer analyzing the speech signal file to obtain the text content of the speech signal file; a prosody analyzer analyzing the speech signal file to obtain the prosodic information of the speech signal file; a tagging device automatically tagging the text content and the corresponding prosodic information to obtain a text tag file. The prosody mimicking apparatus receives the text tag file. Besides, the prosody mimicking apparatus includes an analyzer and a speech synthesizer. The analyzer analyzes the text tag file to obtain the text content and the prosodic information, and the speech synthesizer synthesizes a human voice profile, the text content, and the prosodic information to obtain the speech synthesis file.

In view of the foregoing, the prosodic information in the speech signal file is automatically obtained, and the prosodic information is further mimicked to generate the speech synthesis file in the same form as if it is actually spoken or generated by people in conversation.

In order to make the aforementioned and other features and advantages of the disclosure more comprehensible, embodiments accompanying figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

The tone and intonation contained in a speech synthesis file obtained through the existing text-to-speech (TTS) system are still distinct from those of human speech. The disclosure is directed to a speech synthesis method for an electronic system and a speech synthesis apparatus. After detecting prosodic variations in a human speech, prosodic information may be obtained and mimicked by a mechanical speech synthesis system. In order to make the present disclosure more comprehensible, embodiments are described below as examples to elucidate the realization of the present disclosure.

Figure 1:
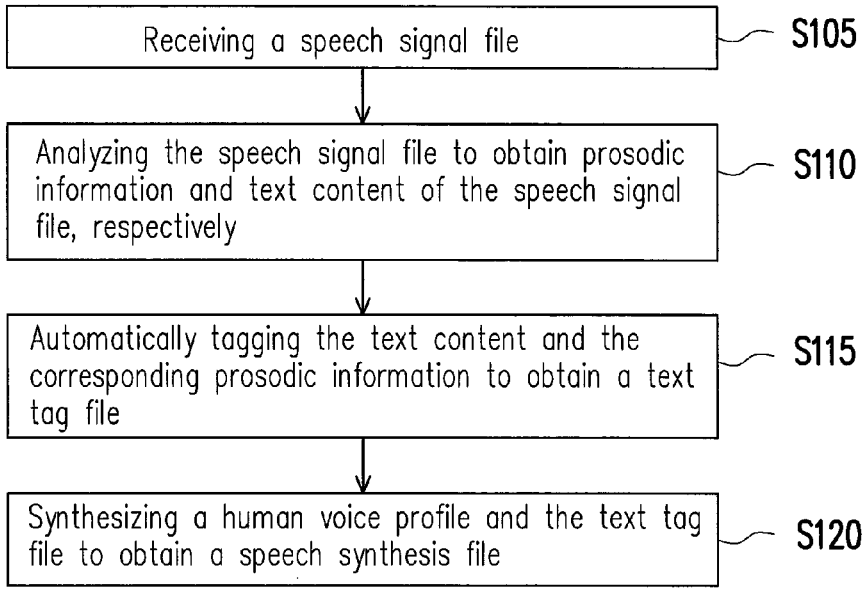
FIG. 1 is a flow chart illustrating a speech synthesis method according to an embodiment of the disclosure.

FIG. 1 is a flow chart illustrating a speech synthesis method for an electronic system according to an embodiment of the disclosure. In this particular embodiment, the electronic system applied the speech synthesis method of the present disclosure may be a personal computer, a notebook computer, a mobile phone, a smart phone, a personal digital assistant (PDA), an electronic dictionary, an automatic storyteller, a robot, and so on. Besides, the electronic system would further include an input unit, a processing unit, an output unit, and a processing unit through which the speech synthesis method could be implemented.

Here, the speech synthesis method could be divided into a text tagging process and a prosody mimicking process. Referring to FIG. 1, the text tagging process may include the steps from S105 to S115, and the prosody mimicking process may include the step S120. In the text tagging process, after the text content and the corresponding prosodic information are automatically tagged, the prosodic information contained in a text tag file could then be directly mimicked in the prosody mimicking process. The detailed description is given as follows.

First, the text tagging process is performed to obtain the text tag file. In step S105, a speech signal file is received. Here, a user recites text contents in a text, and the recitation is recorded by a voice receiver or another input unit so as to generate the speech signal file. In step S110, the speech signal file is analyzed to extract the prosodic information and the text content of the speech signal file, respectively. Here, the prosodic information includes at least one of intensity, volume, pitch, and duration or a combination thereof. In step S115, the text content and the corresponding prosodic information are automatically tagged to obtain a text tag file. The text tag file may be further stored and applied in the subsequent prosody mimicking process.

For instance, the text tag file may be an extensible markup language (XML) file. In "<pitch middle="6">This text should be spoken at pitch five.</pitch>", the prosodic attribute "middle" serves to determine a relative pitch of voice. Through the tag of the XML file, each sentence of the text content is tagged.

After the text tag file is obtained, the prosody mimicking process may be performed. In step S120, a speech synthesis file is obtained by synthesizing a human voice profile and the text tag file. Thereafter, the speech synthesis file may further be outputted through an audio output unit. Here, in the human voice profile, the human voice models could be utilized according to different human characters and scenarios in the text content. For instance, a normal speech synthesizer may include a plurality of human voice models, e.g., six male voice models and six female voice models. It should be noted that the number of the human voice models described herein is exemplary and should not be construed as a limitation to the disclosure. In the human voice profile, the human voice model correspondingly utilized for pronouncing each sentence in the text content is set. Given that the text content includes six sentences A to F, the human voice models of the human voice profile respectively corresponding to the six sentences A to F are set. Here, a user may self determine the human voice model of the human voice profile corresponding to each sentence.

The electronic system includes a text tagging apparatus and a prosody mimicking apparatus. The text tagging process is performed by the text tagging apparatus, and the prosody mimicking process is performed by the prosody mimicking apparatus. The text tagging apparatus and the prosody mimicking apparatus may be integrated in one physical product or may be individually disposed in different physical products.

The text tagging apparatus and the prosody mimicking apparatus are respectively exemplified hereinafter.

Figure 2:
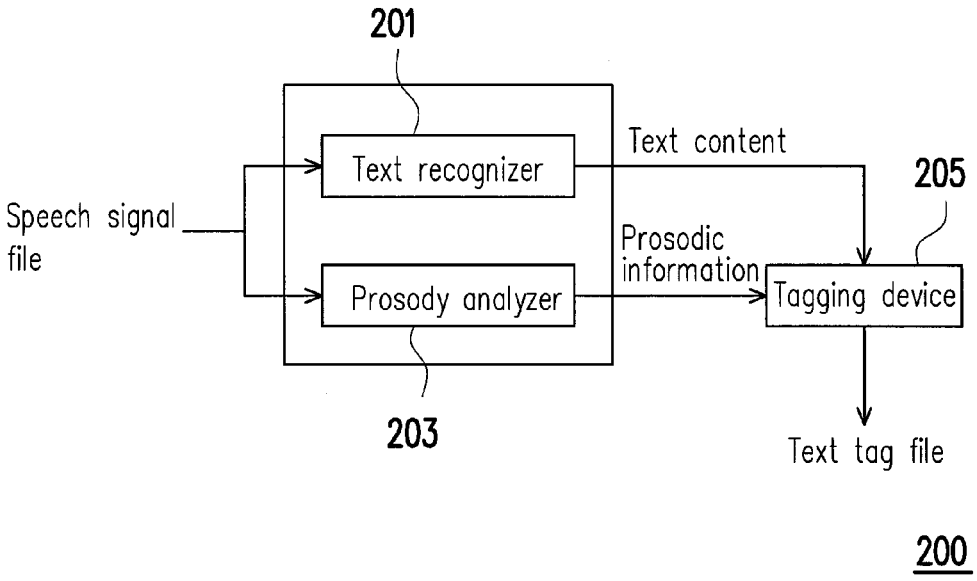
FIG. 2 is a schematic view illustrating a text tagging apparatus according to an embodiment of the disclosure.
Figure 3:
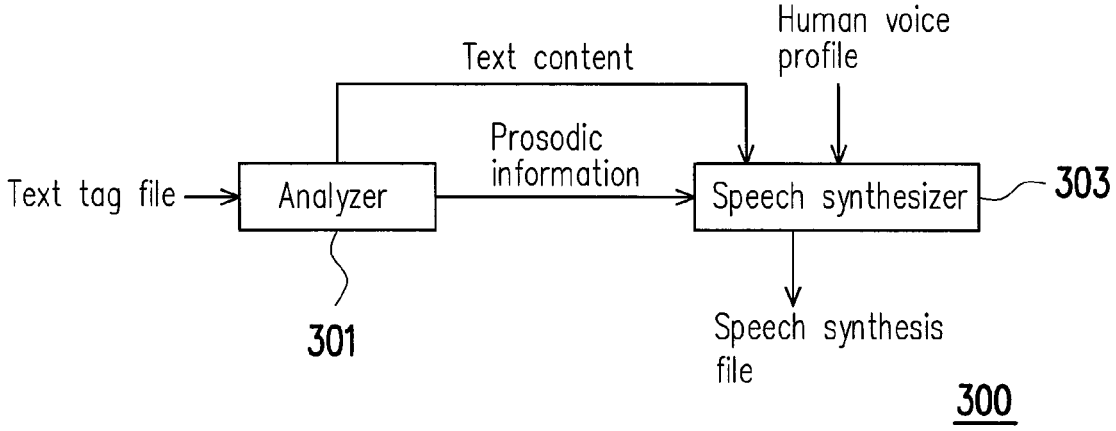
FIG. 3 is a schematic view illustrating a prosody mimicking apparatus according to an embodiment of the disclosure.

FIG. 2 is a schematic view illustrating a text tagging apparatus 200 according to an embodiment of the disclosure. FIG. 3 is a schematic view illustrating a prosody mimicking apparatus 300 according to an embodiment of the disclosure. Referring to FIG. 2 and FIG. 3, the text tagging apparatus 200 serves to receive a speech signal file so as to convert the speech signal file into a text tag file. The text tagging apparatus 200 may include a text recognizer 201, a prosody analyzer 203, and a tagging device 205. The prosody mimicking apparatus 300 serves to receive the text tag file so as to generate a speech synthesis file according to prosodic information. The prosody mimicking apparatus 300 may include an analyzer 301 and a speech synthesizer 303. The text recognizer 201, the prosody analyzer 203, the tagging device 205, the analyzer 301, and the speech synthesizer 303 may be embodied respectively in the form of a very large integrated circuit (VLSI) containing a plurality of digital logic gates or in the form of programming code snippets which are stored in a storage unit or as firmware to be executed by a processing unit.

After receiving the speech signal file, the text recognizer 201 obtains the text content of the speech signal file through speech recognition algorithm. After receiving the speech signal file, the prosody analyzer 203 extracts the prosodic information from the speech signal file. For instance, the prosody analyzer 203 analyzes waveforms of the speech signal file to acquire the prosodic information that includes intensity, volume, pitch, duration, and so forth.

After respectively obtaining the text content and the prosodic information, the text recognizer 201 and the prosody analyzer 203 respectively input the text content and the prosodic information to the tagging device 205. After respectively obtaining the text content and the prosodic information from the text recognizer 201 and the prosody analyzer 203, the tagging device 205 automatically tags the text content and the corresponding prosodic information to obtain a text tag file.

After acquiring the text tag file, the text tagging apparatus 200 transmits the text tag file to the prosody mimicking apparatus 300. In the case which the text tagging apparatus 200 and the prosody mimicking apparatus 300 are implemented by separate physical systems, the text tagging apparatus 200 may upload the text tag file to a cloud server, and the prosody mimicking apparatus 300 may download the text tag file form the cloud server; alternatively, the text tag file may be transmitted between the text tagging apparatus 200 and the prosody mimicking apparatus 300 through an external storage device. In case that the text tagging apparatus 200 and the prosody mimicking apparatus 300 are implemented in the same physical system, the text tagging apparatus 200 directly transmits the text tag file to the prosody mimicking apparatus 300.

In the prosody mimicking apparatus 300, after the analyzer 301 receives the text tag file, the analyzer 301 analyzes the text tag file to obtain the text content and the prosodic information therein and transmits the text content and the prosodic information to the speech synthesizer 303. The speech synthesizer 303 receives the human voice profile as well as the text content and the prosodic information transmitted by the analyzer 301, selects the corresponding human voice model according to the human voice profile, and adjusts the speech synthesis file according to the prosodic information.

That is, the speech signal file may be recorded by a person, and the text tag file containing the prosodic information may be generated after the prosodic information contained in the speech signal file is analyzed and extracted. The text tag file is then input to the prosody mimicking apparatus 300 to perform the prosody mimicking process, such that the speech synthesis file may be more similar to human voice.

Figure 4:
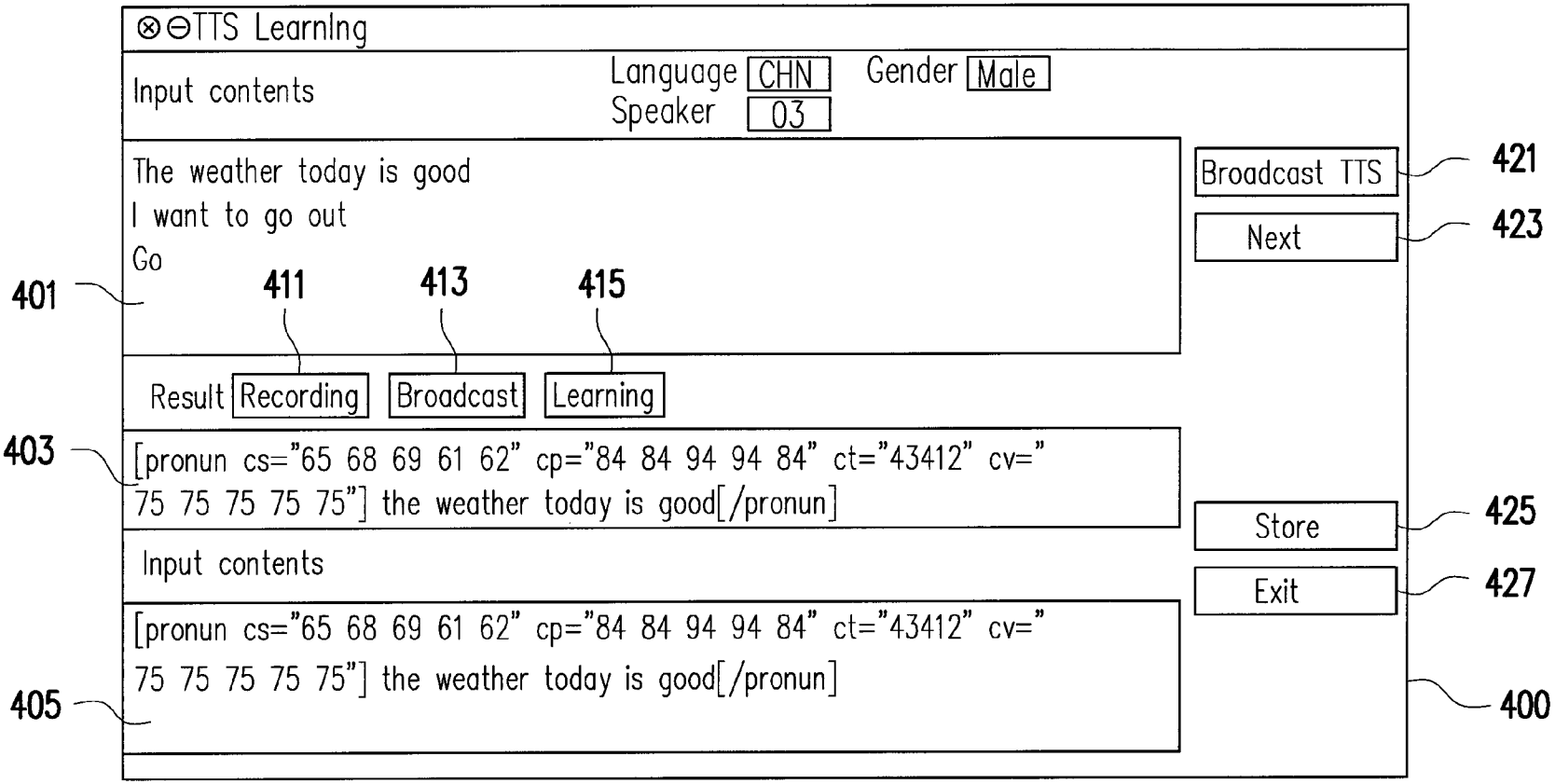
FIG. 4 is a schematic view illustrating a user's interface according to an embodiment of the disclosure.

The text tagging apparatus 200 may further provide a user interface. FIG. 4 is a schematic view illustrating a user interface according to an embodiment of the disclosure. With reference to FIG. 4, the user interface 400 includes pages 401, 403, and 405. The page 401 displays text content, the page 403 displays contents of the text tag file generated by recording the human voice, and the page 405 displays the to-be-output contents of the text tag file.

Functions including a recording function 411, a broadcast function 413, and a learning function 415 may be performed through the user interface 400. Here, the recording function 411, the broadcast function 413, and the learning function 415 are implemented through buttons, for instance. When the recording function 411 is performed, the speech signal file is received, i.e., a human voice recording process is performed. When the learning function 415 is performed, the speech signal file is analyzed to obtain the prosodic information of the speech signal file; the prosodic information corresponding to the text content is automatically tagged to obtain the text tag file; the speech synthesis file is obtained by synthesizing the human voice profile and the text tag filed. When the broadcast function 413 is performed, the speech synthesis file is broadcast. For instance, the speech synthesis file is output through an audio output unit (e.g., a speaker).

A broadcast TTS function 421, a next function 423, a store function 425, and an exit function 427 may also be performed through the user's interface 400. The broadcast TTS function 421 serves to directly broadcast the selected sentence of page 401, i.e., the speech synthesis file whose prosodic information has not yet adjusted. The next function 423 serves to select the next sentence. The store function 425 serves to store the contents of the text tag file (the contents displayed on page 403) obtained after the recording process is performed. The exit function 427 serves to end the use of the user's interface 400.

For instance, by taking a sentence "the weather today is good" as an example, a user may enable the recording function 411 and record through an input unit (e.g., a microphone), and the speech signal file is generated after the recording is finished,. The learning function 415 is then performed to obtain the text tag file of the recorded sentence and display the contents of the text tag file on the page 403 as "[pronun cs="65 68 69 61 62" cp="84 84 94 94 84" ct="43412" cv="75 75 75 75 75"] the weather today is good [/pronun]",and wherein the prosodic attributes "cs," "cp," "ct," and "cv" respectively refer to intensity, pitch, duration, and volume, and the values of the prosodic attributes are relative values.

In the case that the speech synthesizer 303 includes different human voice modules, only one person would be required to recite the text, and the electronic system may obtain the prosodic information of the recorded speech signal file and then mimic the prosodic information contained in the speech from the person, such that an audio book having various characters with different voices may be automatically created.

In view of the aforementioned descriptions, the present disclosure describes, a text tagging process which is performed to automatically extract the prosodic information from the speech signal file, and a prosody mimicking process is performed to mimic the prosodic information and generate a speech synthesis file, such that the speech synthesis file may be similar to the human voice. Moreover, a user interface is provided to the user to directly adjust each sentence in the text.

Although the disclosure has been described with reference to the embodiments thereof, it will be apparent to one of the ordinary skills in the art that modifications to the described embodiments may be made without departing from the spirit of the disclosure. Accordingly, the scope of the disclosure will be defined by the attached claims not by the above detailed description.

What is claimed is:

1. A speech synthesis method for an electronic system, the speech synthesis method comprising:

performing a text tagging process, comprising:

receiving a speech signal file, wherein the speech signal file comprises text content and prosodic information, wherein the speech signal file is a recorded file of human voice from a user to recite a text content and received by a voice input unit;

analyzing the speech signal file to obtain the prosodic information and the text content of the speech signal file, respectively; and automatically tagging the text content and the corresponding prosodic information to obtain a text tag file; and performing a prosody mimicking process, comprising:

combining a human voice profile and the text tag file to obtain a speech synthesis file, wherein a speech synthesis sound is produced when the speech synthesis file is broadcasted.

2. The speech synthesis method as recited in claim 1, wherein the prosodic information comprises one of intensity, volume, pitch, and duration or a combination thereof.

3. The speech synthesis method as recited in claim 1, wherein the prosody mimicking process further comprises:

analyzing the text content and the prosodic information and extracting the text content and the prosodic information from the text tag file.

4. The speech synthesis method as recited in claim 3, after the step of analyzing the text content and the prosodic information and extracting the text content and the prosodic information from the text tag file, the speech synthesis method further comprising:

combining the human voice profile, the text content, and the prosodic information to obtain the speech synthesis file.

5. The speech synthesis method as recited in claim 1, wherein the human voice profile comprises a plurality of human voice models.

6. The speech synthesis method as recited in claim 5, wherein the human voice models of the human voice profile are utilized according to different human characters and scenarios in the text content.

7. The speech synthesis method as recited in claim 1, after the step of combining the human voice profile and the text tag file to obtain the speech synthesis file, the speech synthesis method further comprising:

outputting the speech synthesis file through an audio output unit.

8. A speech synthesis apparatus comprising:

a text tagging apparatus receiving a speech signal file, wherein the speech signal file comprises text content and prosodic information, and the text tagging apparatus comprises:

a text recognizer analyzing the speech signal file to obtain the text content of the speech signal file, wherein the speech signal file is a recorded file of human voice from a user to recite a text content and received by a voice input unit;

a prosody analyzer analyzing the speech signal file to obtain the prosodic information of the speech signal file; and a tagging device automatically tagging the text content and the corresponding prosodic information to obtain a text tag file; and a prosody mimicking apparatus receiving the text tag file and comprising:

an analyzer analyzing the text tag file to obtain the text content and the prosodic information; and a speech synthesizer combining a human voice profile, the text content, and the prosodic information to obtain the speech synthesis file, wherein a speech synthesis sound is produced when the speech synthesis file is broadcasted by the speech synthesizer.

9. The speech synthesis apparatus as recited in claim 8, wherein the text tagging apparatus further comprises:

a user's interface displaying the text content, a plurality of functions being performed through the user's interface, wherein the functions comprise a broadcast function, a recording function, and a learning function, when the recording function is performed, the speech signal file is received, when the learning function is performed, the speech signal file is analyzed to obtain the prosodic information of the speech signal file, the prosodic information corresponding to the text content is automatically tagged to obtain the text tag file, and the speech synthesis file is obtained by combining the human voice profile and the text tag file, and when the broadcast function is performed, the speech synthesis file is broadcast.

10. The speech synthesis apparatus as recited in claim 8, wherein the prosodic information comprises one of intensity, volume, pitch, and duration or a combination thereof.

* * * * *